United States Patent [19]

Kemmerer

[11] 4,019,714

[45] Apr. 26, 1977

[54] VALVE CONSTRUCTION

[76] Inventor: Marlin Kemmerer, 2511 S. Lloyd St., Philadelphia, Pa. 19142

[22] Filed: Oct. 24, 1975

[21] Appl. No.: 625,509

Related U.S. Application Data

[62] Division of Ser. No. 566,038, April 7, 1975.

[52] U.S. Cl. ..... 251/138; 251/303; 98/119

[51] Int. Cl.² ..... F16K 1/22

[58] Field of Search ..... 251/298, 129, 303; 137/520, 521, 527.8; 98/119

[56] References Cited

UNITED STATES PATENTS

| | | | |
|---|---|---|---|
| 426,628 | 4/1890 | Smith | 137/520 |
| 1,648,322 | 11/1927 | Olson et al. | 98/119 |
| 2,694,414 | 11/1954 | Seyferth | 251/298 X |
| 2,900,998 | 8/1959 | Lortz | 137/527.8 X |

FOREIGN PATENTS OR APPLICATIONS

| | | | |
|---|---|---|---|
| 1,313,310 | 11/1962 | France | 137/521 |

*Primary Examiner*—Arnold Rosenthal
*Attorney, Agent, or Firm*—Robert K. Youtie

[57] ABSTRACT

A valve construction for use in duct work wherein a valve element extends obliquely across and in closing relation with a duct, pivot means mounting the valve element for swinging movement about a horizontal axis between its oblique closed position and an open position longitudinally of the duct, the pivot means being located relative to the valve element to urge closing of the latter and maintain the latter closed under fluid flow.

2 Claims, 5 Drawing Figures

FIG. 1
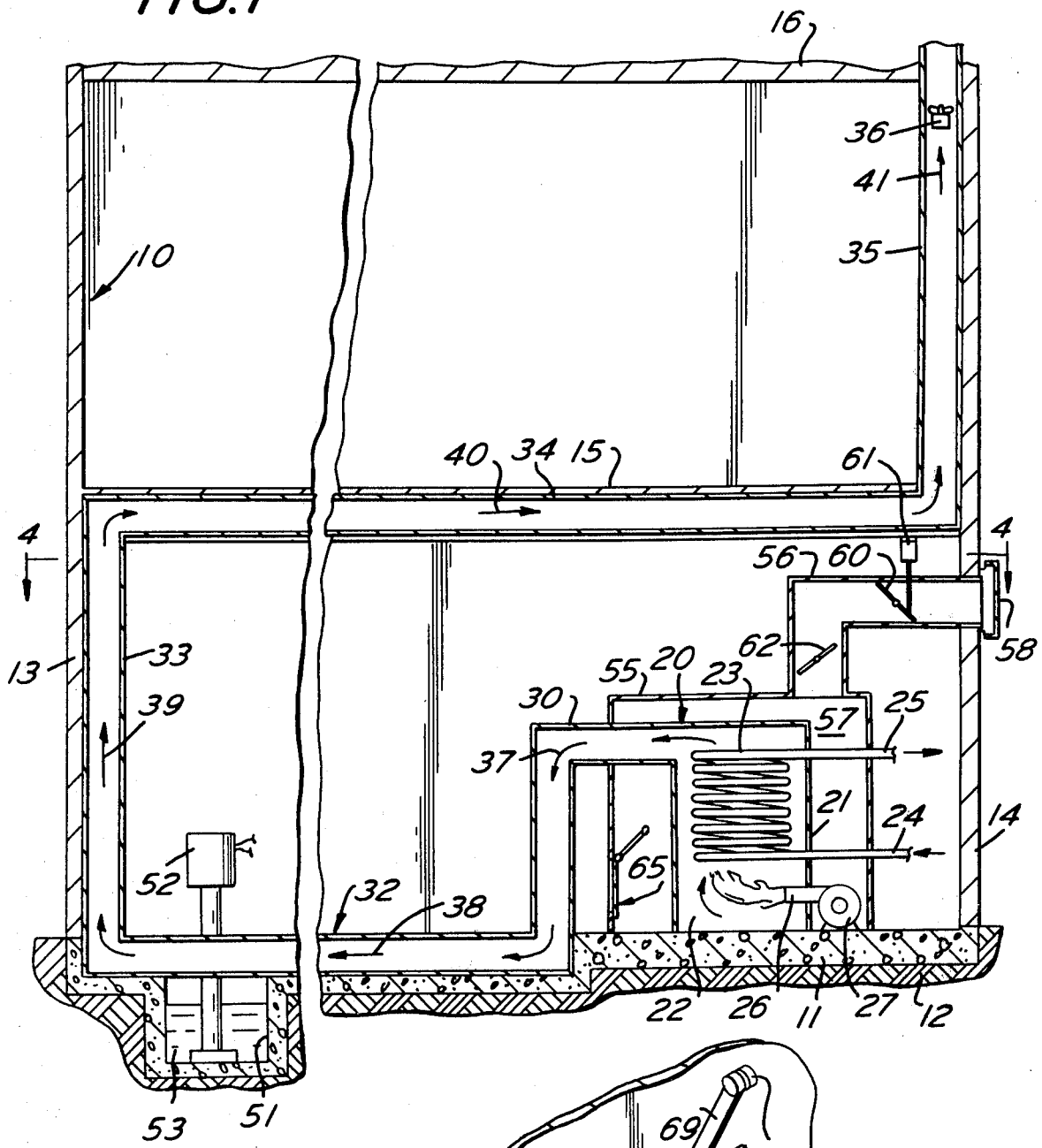
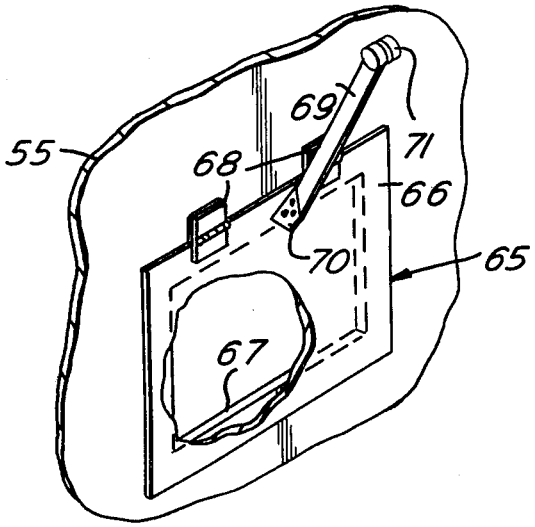
FIG. 3

VALVE CONSTRUCTION

CROSS-REFERENCES TO RELATED APPLICATIONS

This application is a Division of my copending patent application Ser. No. 566,038 filed Apr. 7, 1975 entitled AUXILIARY HEATING EQUIPMENT.

BACKGROUND OF THE INVENTION

While there is illustrated and described herein a valve construction of the present invention in conjunction with a heating system for a building, and the instant valve construction has been primarily developed and employed in such association, it is appreciated that the instant valve construction may be employed in other fluid flow systems, as desired.

SUMMARY OF THE INVENTION

It is an important object of the present invention to provide a valve construction of the type described which is extremely simple in design for the greatly enhanced durability and extreme reliability throughout a long useful life, and which may be economically manufactured, installed and maintained.

It is a further object of the present invention to provide a valve construction having the advantageous characteristics mentioned in the preceding paragraph, admirably well adapted for use in heating system to avoid the waste of previously heated inside air while positively controlling the supply of outside air to avoid or minimize a cooling effect on the heater during off periods.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial sectional elevational view broken away to show a building construction incorporating a heating system and the auxiliary equipment of the present invention.

FIG. 3 is a perspective view, partly broken away, showing a normally-closed interior air inlet.

DESCRIPTION OF THE PREFERRED EMBODIMENT

Figure 4:
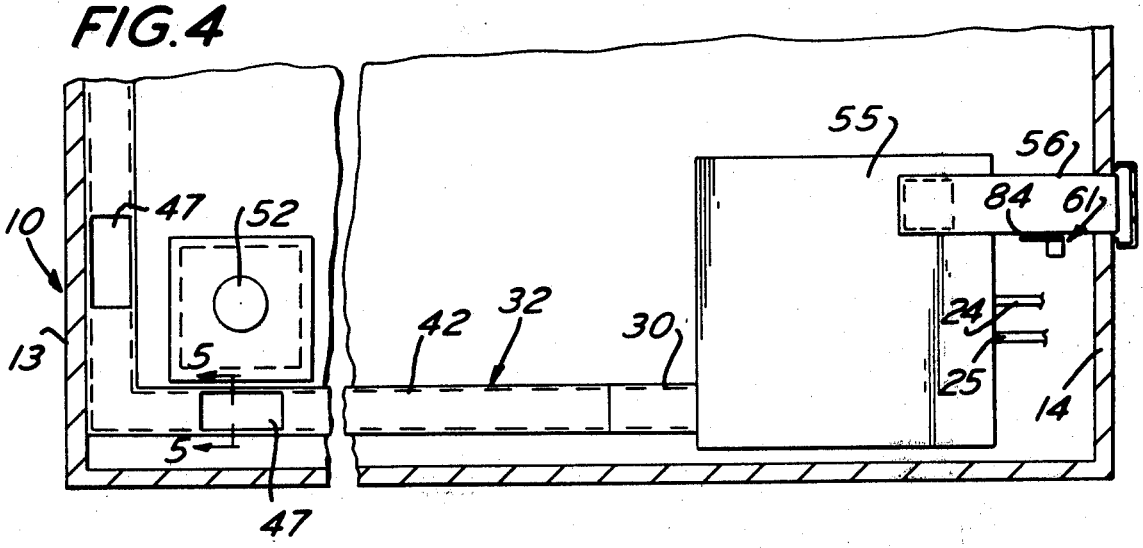
FIG. 4 is a partial horizontal sectional view taken generally along the line 4—4 of FIG. 1.

Referring now more particularly to the drawings, and specifically to FIGS. 1 and 4 thereof, a building structure is there generally designated 10, and may be a dwelling, single or multiple, or commercial building, or other. In the illustrated embodiment the building 10 includes a bottom wall or floor of slab construction 11, resting on the ground 12. Upstanding from the bottom wall or slab 11 are external building walls 13 and 14, which may extend completely around the slab. An intermediate horizontal wall or first floor 15 extends between the side walls 13 and 14, and an upper intermediate wall or floor 16 extends between upper regions of the side walls.

The slab 11 and enclosing side walls 13 and 14 may combine to define a basement, first floor utility room, or the like, and a furnace or heater 20 is mounted on the floor 11. The furnace or heater 20 may be essentially conventional, and for purposes of illustration and without limiting intent, is shown as being a hot water furnace including a casing 21 surrounding a combustion chamber 22 wherein is located a heating coil 23, say for hot water, having a water inlet 24 and a water outlet 25. A burner, as at 26, say for burning gas, oil or other suitable fuel, includes a fan or blower 27 exteriorly of the casing 21 and enters into the casing to terminate in the combustion chamber 22. The blower or fan 27 may serve to move combustion air from exteriorly of the casing 21 into the combustion chamber 22.

Outlet duct means, as at 30, communicates with an upper region of the interior of casing 21 for removing combustion products from the furnace.

Extending from and communicating with the combustion products outlet duct 30, remote from the furnace 20, is suitable radiation duct means 32. The radiation duct means 32 may be recessed into the slab floor 11, having its upper surface generally flush with the latter and extending along the perimeter of the floor adjacent to the building side walls 13 and 14 for a desired length. From the floor radiation duct means 32, there extends an intermediate outlet duct 33 generally vertically upwardly to the floor 15, where an additional length of radiant heat duct means 34 may extend horizontally within the latter floor, say about the perimeter thereof for further conducting the combustion products exiting from the furnace or heater 20. Extending from the discharge end of radiant heat duct means 34 is a flue or outlet duct 35 which may discharge through a chimney (not shown) to the atmosphere. If desired, there may be gas-moving means, such as an exhaust fan 36 located in the flue means 35. Thus, it will now be appreciated that the combustion products of furnace 20 pass in the direction of arrows 37 through the combustion products outlet duct 30, thence in the direction of arrows 38 through radiant heating duct means 32, from which the combustion products pass in the direction of arrow 39 through duct means 33, and thence horizontally through radiant heating duct means 34 in the direction of arrow 40, and finally through flue means 35 in the direction of arrow 41 for discharge to the atmosphere.

Figure 5:
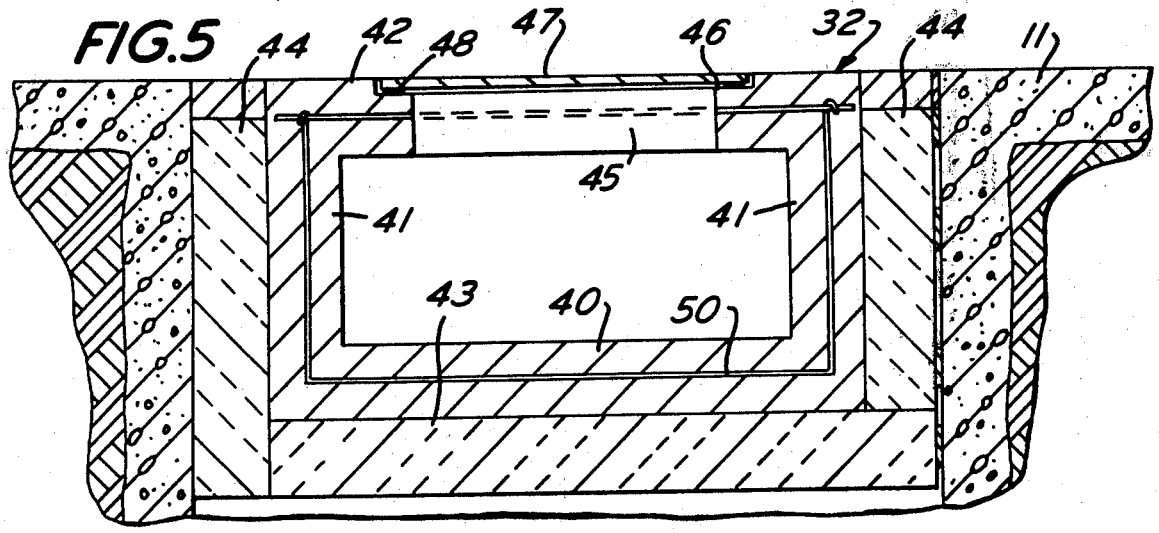
FIG. 5 is a partial sectional view taken generally along the line 5—5 of FIG. 4, enlarged for clarity.

In the slab floor 11, the duct means 32 is advantageously of a concrete construction, see FIG. 5, including a concrete bottom wall 40, concrete side walls 41 upstanding from opposite sides of the bottom wall into and therewith, and a concrete top wall 42 extending between upper regions of the side wall spaced over the bottom wall 40. The radiant heating duct means 32 may be surrounded on its bottom and sides by suitable insulation, as at 43 beneath bottom wall 40, and 44 adjacent to and outward of side walls 41. At spaced locations along the top wall 42, there may be provided through access or inspection openings 45, preferably each surrounded on its upper side with a shoulder 46 removably receiving a closure plate or cover 47 resting on suitable gasket means 48. Advantageously, the integral concrete duct structure of walls 40, 41 and 42 may be suitably reinforced, as by metal reinforcing means 50. In use of the instant equipment with a slab floor, it is preferred to employ a drainage well or sump 51, having associated therewith a suitable sump pump 52, to maintain a level of collected water 53 well below the duct 32 to avoid any cooling or flooding of the duct.

In addition, there is provided in spaced relation about and enclosing the casing 21 of furnace or heater 20, a jacket or enclosure 55. The jacket or enclosure 55 spacedly encloses the casing 21, and the jacket need not be completely air-tight, but substantial air-tightness is desirable. The blower or fan 27 of burner 26 is advantageously located within the enclosure 55 for receiving air from the space between the enclosure and casing 21.

An inlet air duct 56 extends from communication at one end with the space 57 between the enclosure 55 and casing 21, and communication at its other end through the outside wall 14 to the exterior of the building 10, as by a baffle or protective member 58. Thus, outside air may pass from exteriorly of the building 10 inwardly through inlet air duct 56 to jacket space 57 and thence through burner 26 for combustion in chamber 22.

Located in the inlet air duct 56 is an inlet air valve 60 openable to pass outside air into the space 57, and closable to prevent such air passage. Operating means 61 is associated with inlet valve 60 for automatically opening and closing the latter, while an infinitely adjustable valve or damper 62 is advantageously mounted in the inlet air duct 56 between the valve 60 and fan or blower 27. The damper 62 may serve to restrict inlet air movement through duct 56 even when valve 60 is open, to thereby lower the pressure in chamber 57.

There is also provided in one wall of enclosure 55 a safety air inlet 65 for opening the jacket space 57 between enclosure 55 and casing 21 to the interior of building 10. The safety air inlet valve 65 may be a one-way valve responsive to pressure differential, so that upon any failure of the air supply through duct 56, say be clogging of the latter or for other reasons, the fan or blower 27 creates a pressure differential sufficient to open valve 65 and admit air for passage to the combustion chamber 22.

The safety air inlet valve 65 is shown in detail in FIG. 3, as including a generally flat valve member or plate 66 on the inner side of and in covering relation with respect to a wall opening 67 of the enclosure 55. Suitable hinge means 68 swingably suspend the plate 66 in its overlying, closing relation with the wall opening 67. Extending obliquely upwardly and away from an upper region of the plate 66 is an actuating arm or lever 69 which has one end fixed, as by securement means 70, to the plate 66, and is provided on its outer, distal or free end with a suitably calibrated weight 71. Thus, the weight 71 by its lever arm about the hinge means 68, must be overcome by pressure differential, as described hereinbefore, to open the safety air inlet valve 65.

Figure 2:
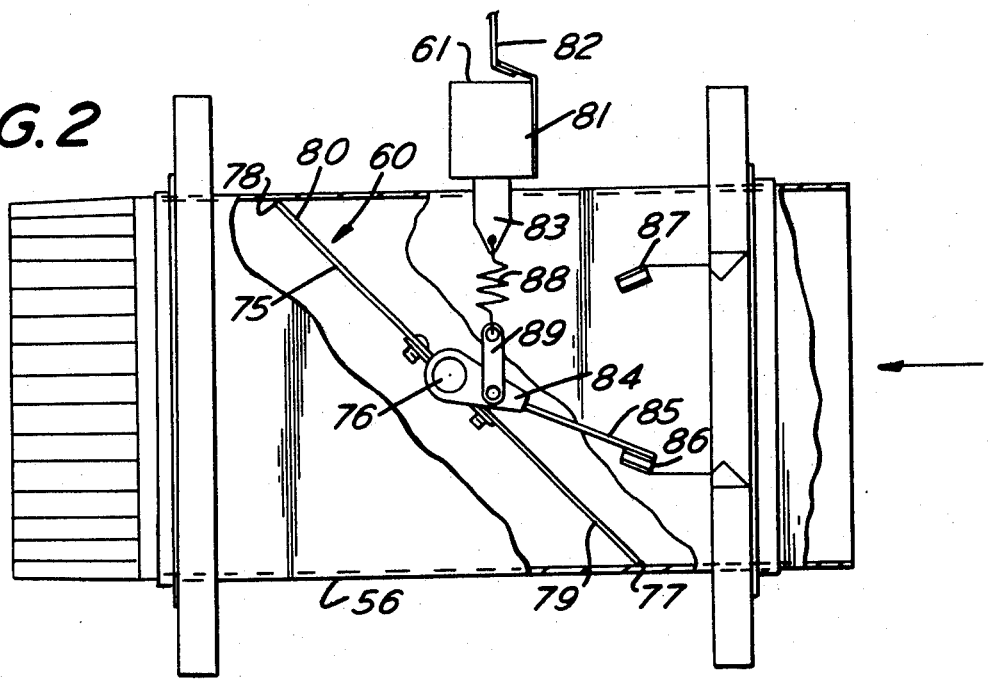
FIG. 2 is an elevational view, partly in section, showing an air inlet valve of the present invention.

The air inlet valve 60 is best seen in FIG. 2. It will there be seen that the valve 60 includes a generally flat valve member or plate 75 having a configuration such as to extend completely across and close the interior of inlet air duct 56 when in an oblique relation with respect to the air duct. More specifically, the valve member or plate 75 closes the air duct 56 when disposed at an angle of 45° with respect to the longitudinal direction of the air duct. A generally horizontally disposed pivot 76 carries the valve plate 75, to mount the valve plate for movement between its closed oblique position, shown in FIG. 2, and an open position extending longitudinally of the duct 56. The pivot 76 has its axis extending horizontally and is secured to the valve plate 75 at a location spaced further from the upstream end 77 of the plate than the downstream plate end 78. Thus, the axis of the pivot 76 may be considered as subdividing the plate 75 into a relatively large upstream region 79 and a relatively small downstream region 80. By this construction and arrangement the valve member 75 will gravitationally swing to its closed position, the upstream region 79 being downward and the downstream region 80 being upward. Further, aerodynamic forces, such as pressure by outside air or vacuum by blower 27 will serve to maintain the valve member 75 in its closed position.

Valve operating means 61 may include a generally vertically disposed solenoid 81 carried by hanger 82 and having a plunger 83 depending along an axis upstream of the pivot axis of pin 76. An arm 84 may extend from pivot pin 76, exteriorly of the duct 56, and has its free end 85 swingable together with the valve member 75 between limiting positions engaging stops 86 and 87. That is, with the arm 84 having its free end 85 in the limiting position engaging stop 86, the valve plate 75 is in its closed position, and upon 45° rotation, counterclockwise as seen in FIG. 2, the free arm end 85 will be in limiting abutting engagement with stop 87 and the valve plate 75 in its open, horizontal position, longitudinally of the duct 56.

Connection means, such as a resilient tension member 88 and a link 89 may connect the plunger 83 to the arm 84. Thus, upon downward extension of plunger 83 the valve plate 75 is released for gravitational downward movement to its closed position, as illustrated. Upon upward shifting movement of plunger 83, the arm 84 as through connection spring 88 and link 89 swings upward to move valve plate 75 into its open longitudinal position.

Suitable electrical interconnection is made between fan or blower 27 and inlet valve operating means 61, so that the inlet valve 60 is open when the fan is working. Further, the valve 60 closes when the fan 27 is not working, so that escape or cooling of heated air is avoided or minimized. Of course, the blower 27 and inlet air valve operating means 61 are advantageously electrically connected to thermostatic means for automatic operation; and further, a float switch may be located in the sump 51 to disable the thermostat circuit in the event of an excessively elevated water level.

From the foregoing it is seen that the present invention provides a highly improved valve construction for use with a building heating system which fully accomplishes its intended objects and is well adapted to meet practical conditions of manufacture, installation and use.

Although the present invention has been described in some detail by way of illustration and example for purposes of clarity of understanding, it is understood that certain changes and modifications may be made within the spirit of the invention.

What is claimed is:

1. A valve construction comprising a duct, a valve element extending across and in closing relation with the duct when oblique to the duct axis, freely rotative generally horizontal pivot means mounting said valve element in said duct for swinging movement about a generally horizontal axis between said oblique closed position and a longitudinal open position, said pivot means being spaced from the center of said valve element downstream of said duct so that the valve element portion upstream of the pivot means is of relatively greater area and weighted for gravitational movement of the upstream region of said valve element to said oblique closed position with fluid flow from the upstream duct region aiding in maintaining said valve element closed, an arm exteriorly of the duct extending from said pivot means rigidly relative to said valve element and at an angle thereto for up and down swinging movement on respective opening and closing of said valve element, and solenoid actuated valve operating means depending toward and connected to said arm to operate the valve element against the force of gravity and differential fluid pressure.

2. A valve construction according to claim 1, said valve element in said oblique closed position being disposed generally 45° with respect to the longitudinal duct direction, and stop means engageable with said arm to limit valve element movement to the longitudinal open position.

* * * * *